United States Patent [19]

Duchin

[11] Patent Number: 4,682,721

[45] Date of Patent: Jul. 28, 1987

[54] TAG DISPENSING AND ATTACHING APPARATUS

[75] Inventor: Daniel Duchin, Wantagh, L. I., N.Y.

[73] Assignee: Monarch Marking Systems, Inc., Dayton, Ohio

[21] Appl. No.: 811,902

[22] Filed: Dec. 20, 1985

Related U.S. Application Data

[62] Division of Ser. No. 553,080, Nov. 18, 1983, Pat. No. 4,610,385.

[51] Int. Cl.[4] ..... B31F 7/00

[52] U.S. Cl. ..... 227/67

[58] Field of Search ..... 227/67, 19, 121, 120, 227/128; 221/215, 232, 242

[56] References Cited

U.S. PATENT DOCUMENTS

| | | | |
|---|---|---|---|
| 2,331,252 | 10/1943 | Van Tuyl | 227/76 |
| 2,915,753 | 12/1959 | Ruskin | 227/128 |
| 3,012,484 | 12/1961 | Braun | 227/76 |
| 3,022,508 | 2/1962 | Ruskin | 227/3 |
| 3,385,498 | 5/1968 | Downie | 227/18 |
| 3,595,460 | 7/1971 | Pitkin | 227/48 |
| 3,598,025 | 8/1971 | Cotton | 227/67 X |
| 3,734,375 | 5/1973 | Bone et al. | 227/67 |
| 3,880,339 | 4/1975 | Bone | 227/8 |
| 3,896,713 | 7/1975 | Mato | 227/67 X |
| 3,898,725 | 8/1975 | Carter, II | 227/67 X |
| 3,948,128 | 4/1976 | Russell | 227/67 X |
| 4,040,555 | 8/1977 | Jenkins | 227/67 |
| 4,049,179 | 9/1977 | Jenkins | 227/67 |
| 4,237,779 | 12/1980 | Kunreuther | 227/67 X |
| 4,315,587 | 2/1982 | Ritter et al. | 227/67 |
| 4,323,183 | 4/1982 | Duchin | 227/67 X |
| 4,458,835 | 7/1984 | Li et al. | 227/121 |
| 4,526,310 | 7/1985 | Lundén et al. | 227/120 |

FOREIGN PATENT DOCUMENTS

| | | | |
|---|---|---|---|
| 91410 | 10/1983 | European Pat. Off. . | |
| 38998 | 10/1978 | Japan . | |
| 55-116544 | 9/1980 | Japan . | |
| 57-16824 | 4/1982 | Japan . | |
| 81/2269 | 8/1981 | PCT Int'l Appl. | 227/19 |

*Primary Examiner*—Paul A. Beli

*Attorney, Agent, or Firm*—Joseph J. Grass

[57] ABSTRACT

First and second separately actuatable triggers are mounted to a housing which carries a hollow needle through which a fastener is dispensed. The needle is mounted to the housing for movement between original and extended positions. The article to be tagged is situated adjacent the front of the housing. When the first trigger is depressed, a tag is moved from a stack on the housing into alignment with the needle as the needle is moved forward to pierce the tag and article. Also, a fastener is fed into the needle. When the second trigger is depressed, the fastener is moved through the needle such that the T-bar end is situated behind the article and the needle retracts to its original position. The apparatus is pulled away from the article, leaving the tag affixed by the fastener. The apparatus is lightweight, easily manipulatable, and can be operated by a single hand.

16 Claims, 12 Drawing Figures

FIG. 7
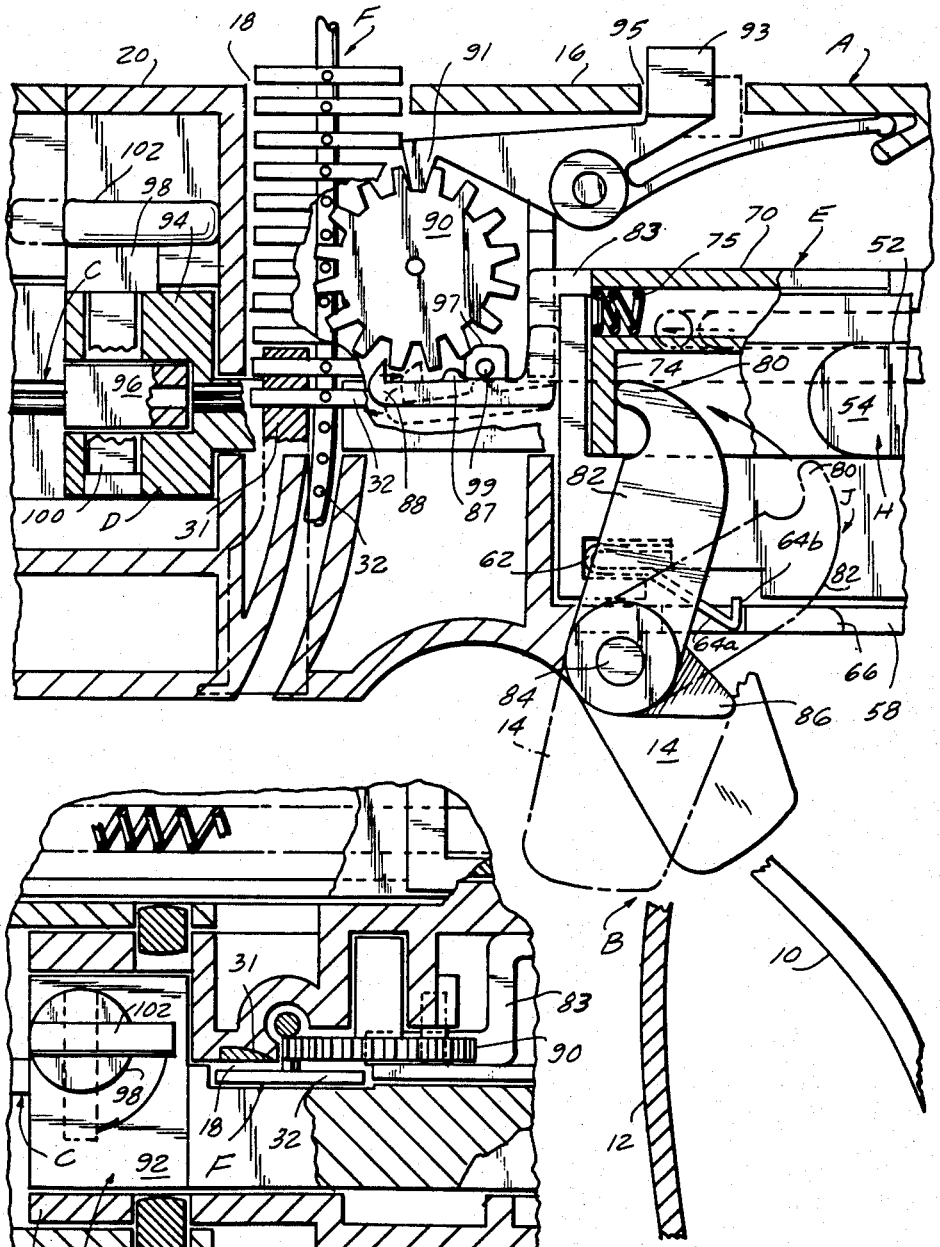
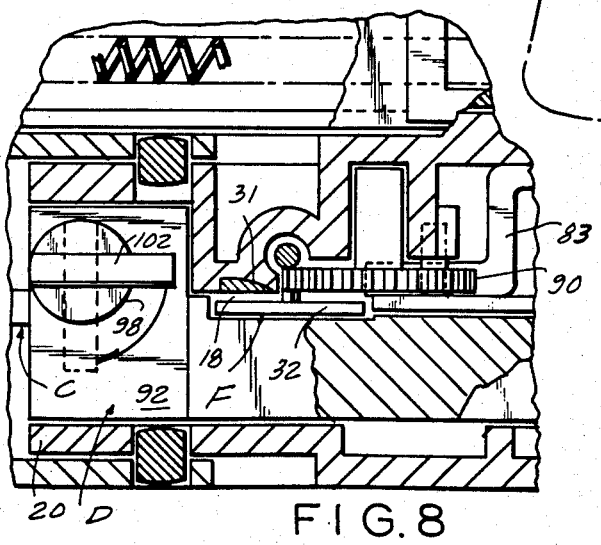
FIG. 8

TAG DISPENSING AND ATTACHING APPARATUS

CROSS-REFERENCE TO RELATED APPLICATION

This application is a division of Ser. No. 553,080, filed Nov. 18, 1983 U.S. Pat. No. 4,610,385.

The present invention relates to tag attaching apparatus and, more particularly, to an apparatus which automatically dispenses a tag and mounts the tag to an article by means of a plastic fastener.

Plastic fasteners, such as the type sold by the Monarch Marking Systems, Inc. of Dayton, Ohio, under the registered trademark TAGGER TAIL and also by other manufacturers, are widely used in the retail industry for attaching labels, tags, and other identifying or information containing objects to a wide variety of soft goods articles for inventory control and pricing purposes. Literally millions of these fasteners are applied to articles during the course of a year, most of which are applied by operators using manually-actuated, hand-held plastic fastener attachers or guns which are sold by a variety of companies for this purpose. Marking systems of this type have been highly commercially successful because of the low price of the fasteners, the ease and relatively low skill required for the attaching operation, and because of the security which is provided due to the structure of the fastener and the material from which it is made, which substantially reduce problems associated with tag switching.

The tag mounting procedure is quite simple. A magazine or clip of plastic fasteners is loaded into the attacher, which is held in one hand of the operator. The operator holds the tag against the article to be tagged in the other hand. The attacher is moved towards the article until the needle fixed to and extending from the front of the attacher penetrates the tag and the article. The operator then actuates the attacher by depressing a trigger-like member such that a single plastic fastener is severed from the clip and dispensed through the needle. This causes the T-bar end of the fastener to be situated behind the article, with the filament penetrating the tag and the article. The attacher is then moved away from the article, withdrawing the needle therefrom, and leaving the fastener in place with the filament of the fastener through a hole in the article and the tag, the T-bar end of the fastener lodged behind the article, and the paddle end of the fastener situated in front of the tag. As the operator releases the trigger, the next plastic fastener is moved into position such that the operation can be rapidly repeated.

Notwithstanding the fact that the plastic fasteners are quite inexpensive and, thus, the per unit tagging costs are low, the aggregate costs involved in the tagging operation are high. This is because virtually every article of softgoods which is sold must be tagged in this manner, requiring a great deal of time and labor.

Users and manufacturers of this type of system are continually seeking methods of reducing the overall cost of the marking operation. An analysis of the tagging operation indicates that a significant portion of the time and motion required is a result of the necessity for the operator to remove a single tag from a stack of tags and place it on the needle by inserting the needle through a pre-punched hole in the tag prior to the use of the attacher. Thus, a reduction in time and labor would result if the tag positioning operation could be facilitated.

In my U.S. Pat. No. 4,323,183, issued Apr. 6, 1982 and entitled "Tag Dispenser For Hand-Held Attacher," I describe an apparatus designed to facilitate the tag positioning operation and, thereby, reduce the overall cost of the tag mounting procedure. The device described in my patent includes a support to which a conventional plastic fastener attacher is movably mounted and upon which is situated a stack of tags. A slide is utilized to move a tag along the plane between the stack and a position in alignment with the needle of the attacher.

The attacher is mounted to the support by a plate which is movable relative to the support between a position wherein the needle is remote from the plane of slide movement and a position where the needle intersects the plane. As the needle intersects the plane of the slide, it pierces the tag which is held in position by an anvil with a needle receiving opening. The attacher is then actuated in the conventional manner. Slide movement may be accomplished manually or automatically in conjunction with the movement of the attacher by using a mechanical linkage, an electrically driven motor, a solenoid, or a pneumatic cylinder.

The device described in the aforementioned patent functions acceptably, but requires that the article and the support be held stationary as the attacher is moved forward relative to the support, to enable the needle to pierce the tag and the article. The attacher must be held in the forward position, against the action of a spring, as it is actuated by depressing a trigger to dispense the plastic fastener. Thus, two separate motions were required—one to move the fastener forward against the action of the spring, and a second to squeeze the trigger while the attacher was held in the forward position. It has been found that after repeated operations of this device, the operator often became fatigued and, thus, some of the time saving advantage of this device was lost. In addition, an operator using this device often pricked her/his finger as the needle burst through the tag and into the article, as the attacher was pushed forward.

It is, therefore, a prime object of the present invention to provide a tag dispensing and attaching apparatus which will facilitate the tagging operation without fatiguing the operator.

It is another object of the present invention to provide a tag dispensing and attaching apparatus which is operated entirely by the squeezing of triggers.

It is another object of the present invention to provide a tag dispensing and attaching apparatus wherein the fastener attaching portion need not be moved relative to the tag dispensing portion.

It is another object of the present invention to provide a tag dispensing and attaching apparatus which is light in weight, easily manipulatable, and can be operated by a single hand of the operator.

It is another object of the present invention to provide a tag dispensing and attaching apparatus which is mechanically simple and operates reliably.

It is another object of the present invention to provide a tag dispensing and attaching apparatus which can be constructed of relatively inexpensive parts which cooperate together for a long, useful life with a minimum of maintenance.

It is another object of the present invention to provide a tag dispensing and attaching apparatus which greatly reduces the possibility of injury to the operator from an advancing needle.

It is another object of the present invention to provide a tag dispensing and attaching apparatus which utilizes conventional plastic fastenerss It is another object of the present invention to provide a tag dispensing and attaching apparatus which can be used with large numbers of tags of a variety of different dimensions.

It is another object of the present invention to provide a tag dispensing and attaching apparatus which is primarily designed for hand-held use, but which can easily be adapted to be powered by external means.

In accordance with the present invention, tag attaching apparatus is provided comprising a housing, actuating means, and a hollow needle through which a fastener is dispensed. Means are provided for mounting the needle to the housing for movement between an original position and an extended position. Means are provided for moving a fastener through the needle. Means are provided for moving the needle mounting means from an original position to the extended position, in response to actuation of the actuating means. Means are also provided for causing the fastener moving means to move the fastener through the needle, in response to further actuation of the actuating means.

The means for engaging the needle mounting means includes first slide means mounted within the housing for movement between a first position, remote from the needle mounting means, and a second position, wherein the needle mounting means is operably engaged. The fastener moving means includes second slide means movable with and relative to said first slide means.

The second slide means is mounted for movement relative to the first slide means between a first relative position and a second relative position. The second slide means carries a plunger having a tip. The plunger is movable between an initial position, wherein the tip is remote from the needle, a second position, wherein the tip is within the needle, and a third position wherein the tip pushes the fastener out of the needle. The tip is within the needle when the first slide is in its second position and the second slide is in its first relative position and pushes the fastener out of the needle when the second slide is in the second relative position.

Means are provided for urging the first slide means towards the first position. Means are also provided for latching the first slide means in its second position.

The actuating means includes first and second actuators, preferably in the form of individually actuatable triggers. The first actuator is effective, when actuated, to move the first slide means from its first position to its second position. The second actuator is effective, when actuated, to release the latching means. Thus, when the second actuator is actuated, the first slide means is returned to its first position by the urging means.

The second actuator is also effective, when actuated, to move the second slide from its first relative position to its second relative position with respect to the first slide. Thus, actuation of the second actuator causes the plunger to complete its movement through the needle, thereby causing the fastener to be dispensed.

The apparatus also includes tag dispensing means. The tag dispensing means is operably connected to the actuating means. The tag dispensing means is effective, upon actuation of the actuating means, to move a tag into alignment with the needle.

The tag dispensing means is actuated, by the actuating means, prior to the needle mounting means reaching its extended position. The tag is positioned in alignment with the needle prior to the needle mounting means reaching its extended position. Thus, the tip of the needle can pierce the tag and, thereafter, retain the tag in the aligned position.

The apparatus also includes a tag retaining means. The tag dispensing means includes tag slide means movable between a first position, aligned with the tag retaining means, wherein a tag is engaged, and a second position wherein the engaged tag is aligned with the needle. Means are provided for operably connecting the actuating means and the tag slide means.

This connecting means includes an arm movable between first and second positions in response to the actuation of the actuating means. A pin is carried by the arm. A lever is mounted on the housing for pivotal movement between first and second positions. The lever carries a cam track into which the pin extends. As the arm is advanced, the lever pivots, causing the tag slide means attached thereto to move a tag into alignment with the needle.

The cam track comprises a continuous loop between first and second points. The path includes first section extending in a substantially straight line between the points and a second section extending between the points and including first and second parts. The first and second parts intersect at an angle. Preferably, the angle is less than 180°.

As the arm is advanced, the pin moves along the second track section. As it moves along the first part, a tag is moved into alignment with the needle. As it moves along the second part, the slide retracts. The pin returns to its original position, without moving the slide, along the first track section.

To these and to such other objects which may hereinafter appear, the present invention relates to tag dispensing and attaching apparatus, as described in detail in the following specification, and recited in the annexed claims, taken together with the accompanying drawings, wherein like numerals refer to like parts, and in which:

FIG. 7 is an enlarged fragmentary side view of a portion of the tag dispensing and attaching apparatus of the present invention;

FIG. 8 is an enlarged fragmentary top view of the portion of the tag dispensing and attaching apparatus of the present invention, illustrated in FIG. 7;

Figure 1:
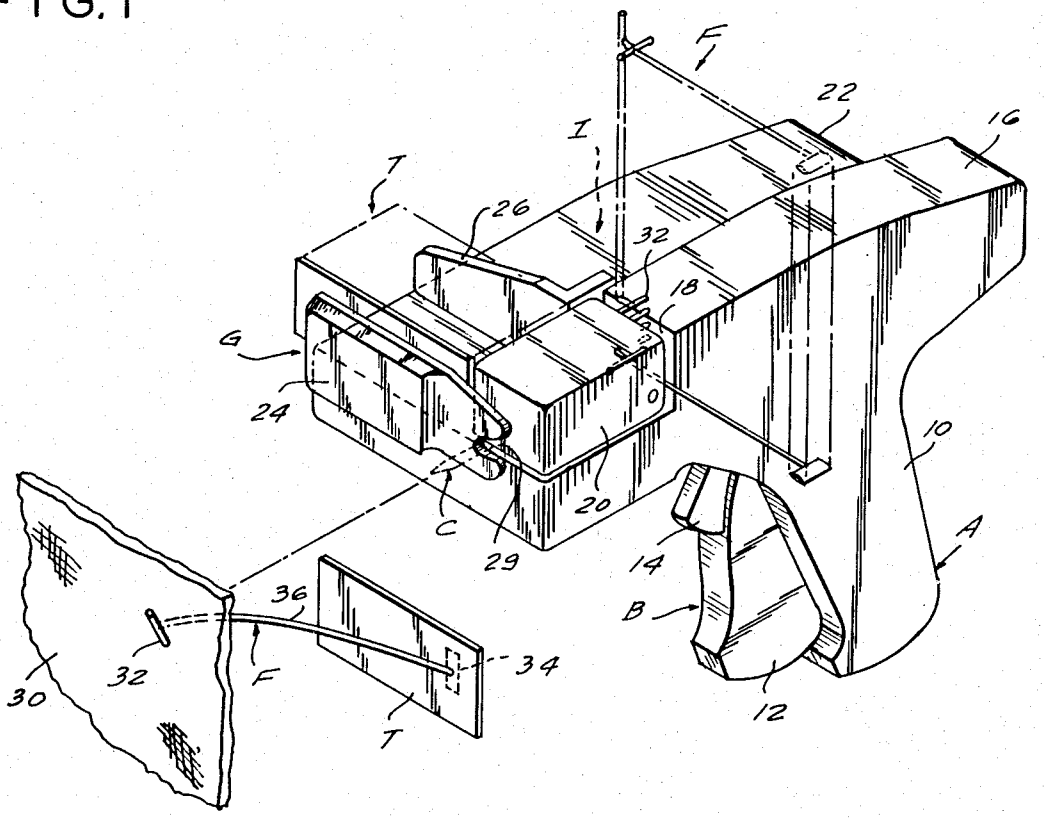
FIG. 1 is an isometric view of the tag dispensing and attaching apparatus of the present invention.
Figure 2:
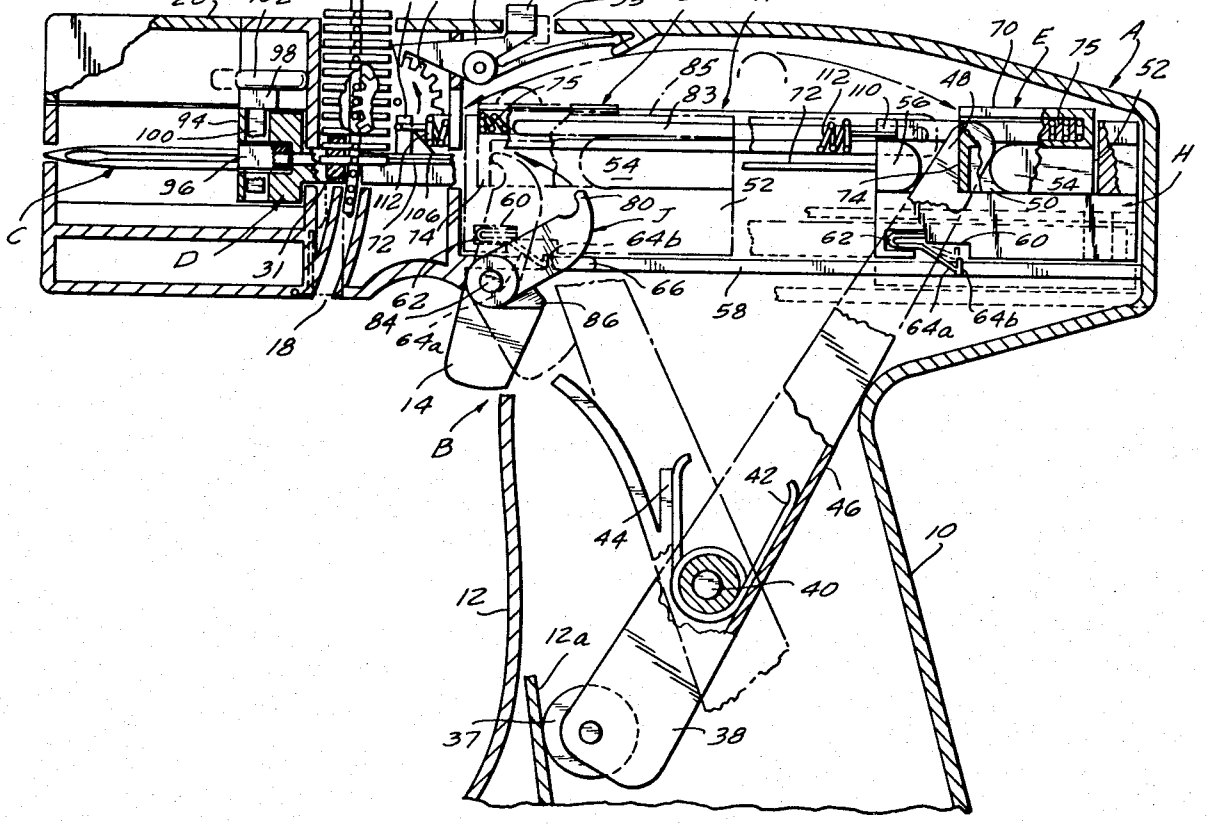
FIG. 2 is a side cross-sectional view of the tag dispensing and attaching apparatus of the present invention, illustrating the various positions of the first and second slides.

As shown in FIGS. 1 and 2, the tag dispensing and attaching apparatus of the present invention comprises a molded plastic pistol-grip type housing, generally designated A. Depressable type actuating means, generally designated B, are situated on the lower portion of housing A. A hollow needle, generally designated C, is mounted on the forward portion of housing A. Needle C is of the conventional type, with an internal bore and a side slot which permits the T-bar end of a plastic fastener F to move through the length of needle C with the filament of the fastener extending through the slot. Means, generally designated D, are provided for movably mounting the needle C to housing A for movement between an original position and an extended position. Means, generally designated E, are provided for moving the T-bar end of the fastener F through needle C. Means, generally designated G, are provided for aligning a tag T with needle C.

Means, generally designated H, are provided for moving needle mounting means D. Means I are provided for connecting actuating means B to tag aligning means G. Means H and I are effective, when actuating means B is actuated, to cause tag aligning means G to align a tag T with needle C and to move needle C from its original position to an extended position to pierce the aligned tag T. Means, generally designated J, are provided for causing fastener moving means E to move a fastener through needle C.

Housing A consists of a grip portion 10 designed to be grasped by the hand of the operator with the fingers of the operator encircling actuating means B. Actuating means B consists of two separately depressable triggers 12 and 14. Trigger 14 is situated to align with the index finger of the operator, whereas trigger 12 is situated to align with the remaining fingers of the operator. This permits triggers 12 and 14 to be separately actuated, in sequence, by the hand of the operator.

The upper portion of housing A includes a main section 16 having a slot 18 at the top thereof into which a clip or assembly of interconnected plastic fasteners F may be received. Forward of slot 18, at the top of housing section 16, is a pivotally connected hood section 20 which provides access to the needle engaging mechanism to permit removal of the needle. Hood section 20 also functions to prevent dirt from entering the mechanism and protects the operator from being injured by the forward advancement of needle C.

Extending outwardly from the right side of housing A, as seen in FIG. 1, is the tag dispensing portion of the present invention. The mechanism for the tag dispensing portion of the present invention is situated within section 22 of housing A. A stack of tags T is situated on the upper surface of housing section 22, adjacent hood 20. The stack of tags T is retained between an anvil 24, fixedly mounted to the front of housing A, and a spring-loaded pressure plate 26 which is mounted to housing A for movement along the top surface of section 22, so as to urge the tag stack against the interior surface of anvil 24.

Figure 4:
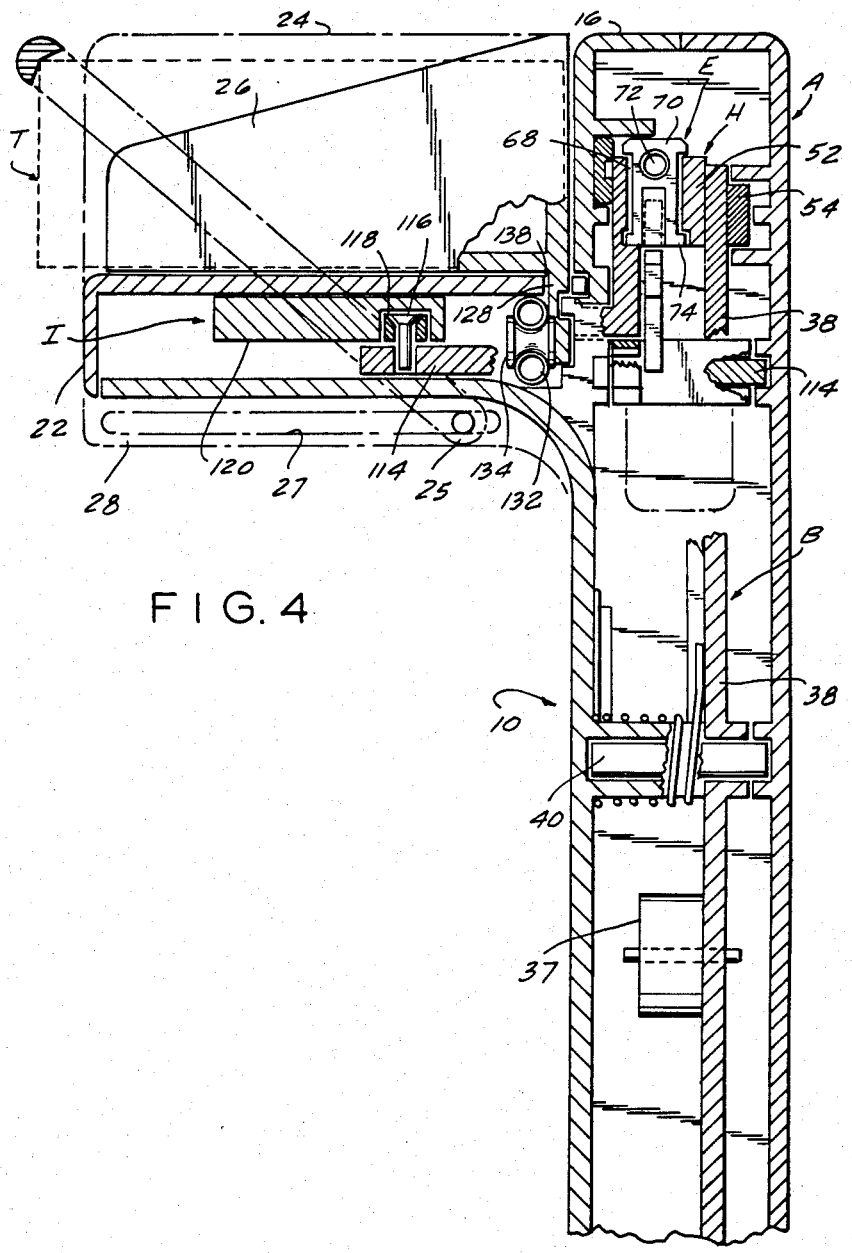
FIG. 4 is a front cross-sectional view of the tag dispensing and attaching apparatus of the present invention, taken along line 4—4 of FIG. 3.
Figure 5:
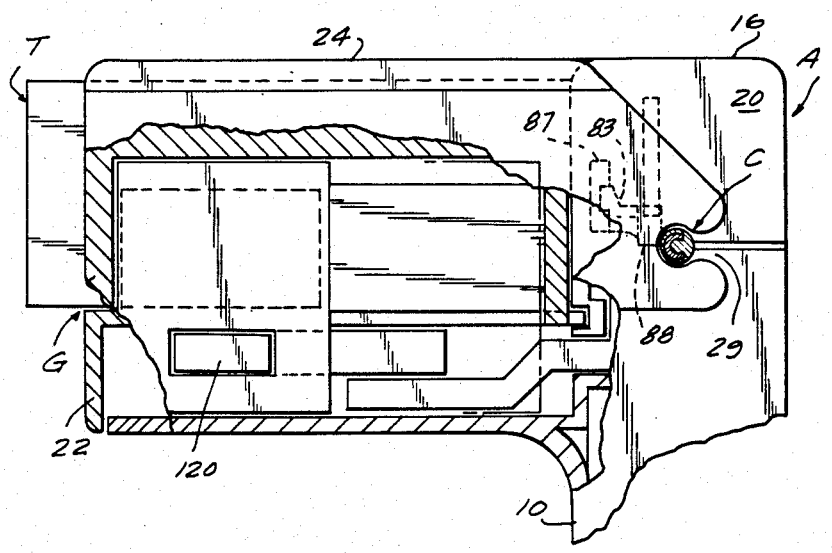
FIG. 5 is a partial front cut-away view of the tag dispensing portion of the tag dispensing and attaching apparatus of the present invention.

The outer edge of the tag stack is held in position by an adjustable arm 25 (see FIG. 4). One end of arm 25 is position adjustably mounted within a slot 27 on a downwardly extending part 28 affixed to the front of housing section 22.

An article 30 to be tagged is held against the front surface of anvil 24. Trigger 12 is depressed, causing a tag T to be moved into a position behind anvil 24 and in alignment with the path of movement of needle C. The depression of trigger 12 also causes a fastener to be severed from the fastener clip as it moves against knife edge 31, situated within housing A immediately behind needle C, and the T-bar end 32 thereof to be pushed into the needle. This occurs as the needle is advanced in the forward direction to pierce tag T, which is held in position behind anvil 24. It should be noted that anvil 24 has a needle receiving opening 29 such that it does not interfere with the forward movement of needle C. The needle is latched in this position so that it can be used as a probe to locate the exact position on the article where the fastener is to be placed.

Trigger 14 is then actuated, causing the T-bar end 32 of the fastener F to be dispensed through needle C such that it is situated on the opposite side of article 30. Housing A and article 30 are then moved apart such that the tag T carried by the fastener F is removed from housing A.

As illustrated in FIG. 1, after the tagging operation is complete, the T-bar end 32 of the fastener F is situated on one side of the article 30 and the paddle end 34 of the fastener is situated on the opposite side of tag T. The filament 36 of the fastener passes through openings in the article 30 and the tag T such that tag T is now connected to article 30 and cannot be removed therefrom without cutting the filament 36.

As illustrated in FIG. 2, trigger 12 has an internal part **12*a* which is situated adjacent a roller 37 mounted on the bottom end of a lever 38. Lever 38 is pivotally mounted within handle portion 10 of housing A at point 40. When trigger 12 is depressed, lever 38 will pivot about point 40 in an arc against the action of a torsion spring 42. Spring 42 has outwardly extending arms situated between the interior surface of an upwardly extending part 44 of grip 10 and the interior surface of the rear wall 46 of lever 38. Spring 42 urges the upper portion of lever 38 toward the rear of housing A, as shown in solid in FIG. 2**.

The upper end 48 of lever 38 has a rounded configuration and is situated within a recess 50 in a slide 52. Slide 52 comprises the means for moving needle mounting means D. Recess 50 is defined between a pair of outwardly extending rounded parts 54, 56 of slide 52. This configuration is designed to permit upper end 48 of lever 38 to be moved relative to slide 52 in a smooth, non-binding manner.

As lever 38 is pivoted, slide 52 will move within housing A from a rear position (shown in solid in FIG. 2) proximate the rear wall of housing A to a forward position (shown in phantom in FIG. 2) near the front wall of the interior of the housing. The movement of slide 52 within housing A is guided by a track 58 which protrudes from the interior surface of the housing wall. As slide 52 approaches its forward position, it will engage needle mounting means D and move same forward to cause needle C to intersect the plane of anvil 24.

At the bottom of slide 52 is a cavity 60 into which a latch spring 62 is received. Latch spring 62 has a downwardly projecting finger 64 having an inclined forward portion **64*a* and a rear portion 64*b* which is substantially perpendicular to the path of movement of slide 52**.

Extending into the interior of housing A from track 58 at the forward portion thereof, is a member 66 which cooperates with latch spring 62 to retain slide 52 in its forward position. Member 66 has an inclined or rounded rear surface which cooperates with portion 64*a* of finger 64 to cam the finger out of alignment with member 66 as slide 52 is moved in the forward direction. When slide 52 reaches the end of its forward motion, the resiliency of finger 64 will cause the finger to lodge in front of the forward surface of member 66. Finger 64 will remain in this position until it is pushed upwardly by the actuation of trigger 14. Latch spring 62 cooperates with member 66 to retain slide 52 in its forward position until it is released.

As best seen in FIG. 4, slide 52 has a recess 68 within which is movably mounted a second slide 70. Recess 68 is substantially larger (in length) than slide 70 so as to permit limited relative movement between slide 70 and slide 52. Slide 70 carries a forwardly extending plunger 72 on its forward wall 74. Plunger 72 moves in a path in alignment with the bore in needle C and functions to push the T-bar end 32 of fastener F through needle C.

Slide 70 is spring loaded toward the rear of recess 68 in slide 52 by a compression spring 75 extending therebetween. As slide 52 moves towards its forward position, spring 75 causes slide 70 to remain at the rear of recess 68. As slide 52 moves forward, plunger 72 will engage the rear end of the T-bar 32 of a fastener F and move same so as to sever fastener F from the remainder of the clip and then to an intermediate position within needle C.

When slide 52 is in its forward position, a protruding finger 80, carried on pivotable arm 82, which forms the means J for moving the fastener moving means E. Arm 82, which is integral with trigger 14, will be situated in a position spaced behind wall 74 of slide 70, and out of alignment with the path of movement of slide 52. Trigger 14 is pivotally mounted on housing A at point 84. When trigger 14 is depressed (see FIG. 7), arm 82 will rotate about point 84 such that finger 80 engages the rear surface of wall 74 and causes slide 70 to move forward relative to slide 52, compressing spring 75. This will cause the tip of plunger 72 to move all the way through needle C and dispense the T-bar end 32 of fastener F from needle C.

Trigger 14 also has a rear lobe 86 on the interior portion thereof. Lobe 86 is aligned with finger 64 of latch spring 62 such that when trigger 14 is depressed, lobe 86 will engage finger 64 and move same upwardly such that portion 64*b* clears part 66. When latch spring 62 clears part 66, slide 52, and slide 70 carried thereby, will move rearwardly back to its original position due to the urging of torsion spring 42 against lever 38. This will also cause needle mounting means D to return to its original position.

Slide 52 has a protrusion 83 extending from the side thereof. Protrusion 83 is situated within an elongated slot 85 on a member 87, the forward portion of which forms a flexible pawl 88.

As slide 52 moves rearwardly, protrusion 83 engages the rear wall of slot 85 causing member 87, including a pawl 88, to move rearwardly a small distance to index a fastener feed wheel 90 in the counterclock-wise direction. Protrusion 83 and slot 85 function as a "lost motion" connection such that slide 52 can move relative to member 87 without causing movement of member 87 except at the extreme ends of the path of movement of slide 52. At the rear end of the path of movement of slide 52 member 87, and thus pawl 88, move rearwardly, indexing wheel 90 and is then depressed, away from wheel 90 through the interaction between a protrusion 97 on pawl 88 and a pin 99 on the housing wall (see FIG. 7). At the front end of the path of movement of slide 52, member 87, and thus pawl 88, move forwardly, a short distance, camming it past the spoke adjacent to it, such that it is positioned for the next indexing of wheel 90.

It should be noted that a spring loaded flexible pawl 91, pivotally mounted near the top surface of housing A, normally serves to prevent wheel 90 from rotating in the clockwise direction. Pawl 91 prevents feed wheel 90 from rotating as member 87 is moved forward to permit pawl 88 to cam past the adjacent spoke, so as to be positioned for the next indexing of wheel 90.

Pawl 91 also has a second function. A pushbutton 93, which forms a part of pawl 91, is accessible from the exterior of housing A through opening 95 and is provided to disengage pawl 91 from feed wheel 90 when depressed. This is possible because of the flexibility of the material from which pawl 91 is made. Once pawl 91 is disengaged, wheel 90 can rotate freely in the clockwise direction (as long as pawl 88 is in the depressed position), permitting the clip of fasteners F to be removed from the apparatus, if necessary.

Feed wheel 90 has a plurality of outwardly extending spaced spokes along its periphery. These spokes are received in the openings between fasteners F (which are spaced along the runner bar of the clip) and engage the individual fasteners F such that the fasteners are moved in step-wise sequence through the gun as wheel 90 is indexed. This causes the T-bar 32 of each fastener F, in sequence, to align with plunger 72 and the bore in needle C. The T-bar end 32 of the next fastener F is fed into the ejection position automatically, in sequence, as slide 52 returns to its original position.

As noted above, slide 52, as it is moved forward, engages the rear end of needle mounting means D. Means D comprises a movably mounted part 94 into which the base 96 of needle C is held by a needle release mechanism 98. The base 96 of needle C is manufactured with a side indentation along its mid-section. The shaft 100 of a needle engaging mechanism 98 is situated be received in the indentation (see FIG. 7). Shaft 100 has a semicircular cross-sectional configuration such that when it is rotated by needle release knob 102 to a first position, the shaft 100 is situated within the indentation in the needle base 96 so as to hole the needle base securely within part 94. When handle part 102 is rotated 180°, shaft 100 is no longer situated within the indentation in needle base 96 and needle C can be moved forwardly relative to part 94 and removed from housing A.

Figure 3:
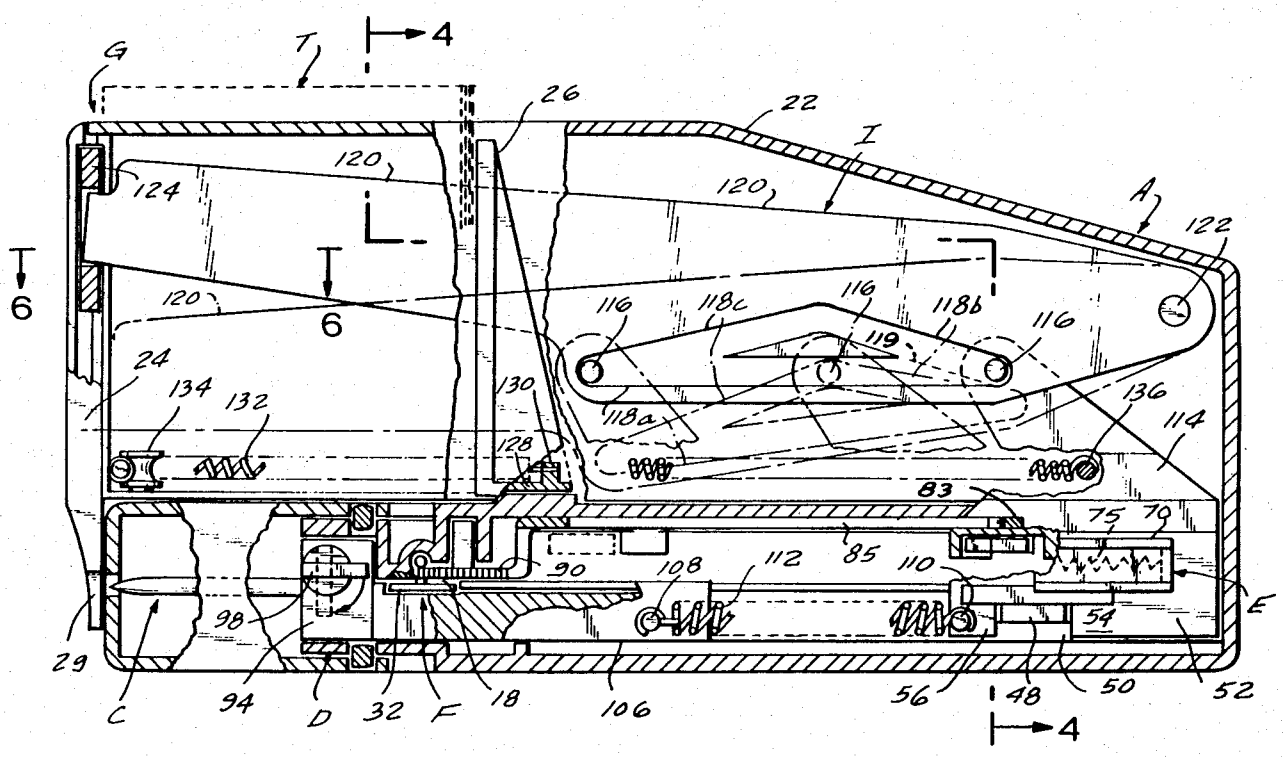
FIG. 3 is a top cross-sectional view of the tag dispensing and attaching apparatus of the present invention, illustrating the operation of the tag dispensing portion.

As is best seen in FIG. 3, part 94 has a rearwardly extending portion 106 (aligned with part 56 on slide 52) which carries an upwardly extending protrusion 108. A similar upwardly extending protrusion 110 is situated on part 56 of slide 52. Extending between protrusions 108 and 110 is a tension spring 112 which operably connects part 94 with slide 52. As slide 52 moves forward, spring 112 is relaxed, and part 56 on slide 52 engages the rear of portion 106, pushing portion 106 and, thus, part 94 forward such that needle C moves forward. As slide 52 returns to its original position, proximate the rear of housing A, spring 112 extends, urges part 94 to move backwards, and needle C to retract.

As best seen in FIGS. 3 and 4, an arm 114 extends outwardly from the lower side portion of slide 52. Arm 114 carries an upwardly extending pin 116 on the outer lobe thereof. Pin 116 is situated within a cam track 118 located on the lower surface of a lever 120. The rear end of lever 120 is pivotally mounted to housing A at point 122 such that lever 120 can move through a limited arc within section 22 of housing A.

The forward end of lever 120 (left, as seen in FIG. 3) is received within a recess in a tag slide 124 which is movable within anvil 24 from an original position (upper position seen in FIG. 3) aligned with the stack of tags T, and a feed position (lower position, as seen in FIG. 3) wherein a tag engaged by slide 124 is in alignment with needle C. As slide 52 is moved forward, lever 120 will move from its original position to the feed position, and then back to its original position. The rearward movement of slide 52 will have no effect on the position of lever 120.

Cam track 118 is a continuous loop having two different paths between the rearwardmost point and the forwardmost point. One section of the track 118*a* is a straight line between the rearwardmost point of the track and the forwardmost point of the track, parallel to the axis of the apparatus. When lever 120 is in its original position, this section permits slide 52 to return from its forward position to its rear position without effecting the position of lever 120. The other section of track 118 comprises two parts 118*b* and 118*c* which meet at an angle, preferably less than 180°.

As slide 52 moves forward, pin 116 first moves along part 118*b* of track 118 such that lever 120 pivots toward needle C. The configuration of the surface of the cam track includes a step 119 which guides pin 116 into part 118*b*, instead of section 118*a*, during the initial portion of its forward movement. As pin 116 reaches the intersection between parts 118*b* and 118*c*, lever 120 is situated at the point closest to needle C, having engaged a tag from the stack and moved it into alignment with needle C. Further forward movement of slide 52 causes pin 116 to ride along part 118*c* of track 118 such that lever 120 reverses direction and moves away from needle C. As pin 116 reaches the forwardmost point in the track, lever 120 has returned to its original position. The return of slide 52 from its forward to its rearward position causes pin 116 to move along portion 118*a* of the track, without moving lever 120.

Figure 6:
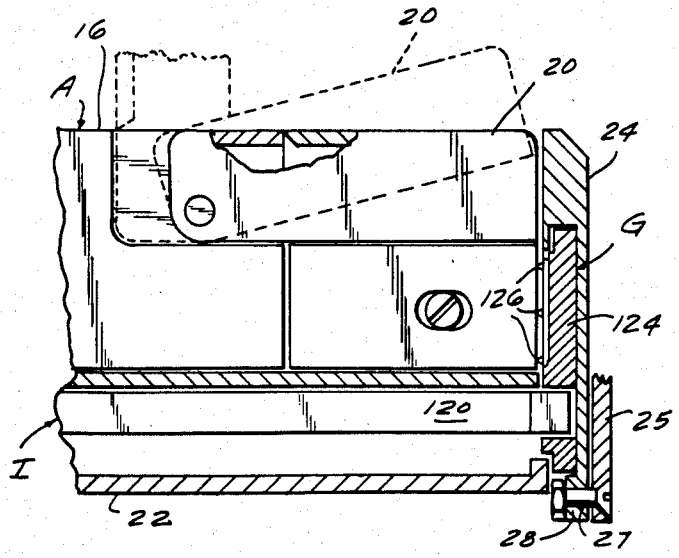
FIG. 6 is a side view of the tag dispensing portion of the tag dispensing and attaching apparatus of the present invention.

As best seen in FIG. 6, tag slide 124 has a plurality of tag engaging teeth 126 on its internal surface. Teeth 126 serve to engage the surface of the first tag T on the stack, which is urged forward by pressure plate 26. Teeth 126 are shaped to engage the tag in one direction and to permit relative movement therebetween in the other direction. As slide 124 moves towards needle C, the tag engaged thereby will move with it, aligning with the path of movement of needle C. As pin 116 reaches the intersection of track parts 118*b* and 118*c*, needle mounting means D and, thus, needle C have moved forward to its extended position, such that the tip of needle C pierces the engaged tag. Anvil 24 holds the engaged tag firmly as needle C penetrates same. Anvil 24 has a needle receiving opening 29 therein so as not to interfere with the forward movement of the needle.

As slide 52 continues to move forward, tag slide 124 moves away from needle C, towards its original position. As this occurs, teeth 126 release the surface of the tag, which is now held in position by the needle, such that the tag slide 124 retracts without the tag. At the end of the forward movement of slide 52, tag slide 124 is fully retracted and teeth 126 are in a position to engage the surface of the next tag in the stack.

Pressure plate 26, as best seen in FIGS. 3 and 4, is spring-loaded towards the front of the apparatus to hold tags T securely. Pressure plate 26 has a downwardly extending portion 128 which carries a horizontally extending protrusion 130. One end of a spring 132 is anchored to protrusion 130. Spring 132 extends around a roller 134, mounted near the front of the housing section 22, and then rearwardly towards the back of housing A where the other end thereof is affixed to an upwardly extending protrusion 136 mounted to housing A.

Downwardly extending portion 128 of pressure plate 26 rides along a slot 138 between the upper surface of housing section 22 and the main portion of housing A so as to guide the movement of the pressure plate. Spring 132 serves to urge pressure plate 26 towards anvil 24 in a substantially uniform manner, even when a large number of tags are situated between the pressure plate 26 and the anvil 24. The length of spring 132 and the method of mounting thereof assures a substantially uniform pressure, regardless of the size of the stack. The position of roller 134 can be adjusted such that the amount of pressure applied to the stack by spring 132 is never so great as to interfere with the movement of the first tag in the stack relative to the remainder of the stack. Thus, jamming is effectively eliminated.

Figure 9:
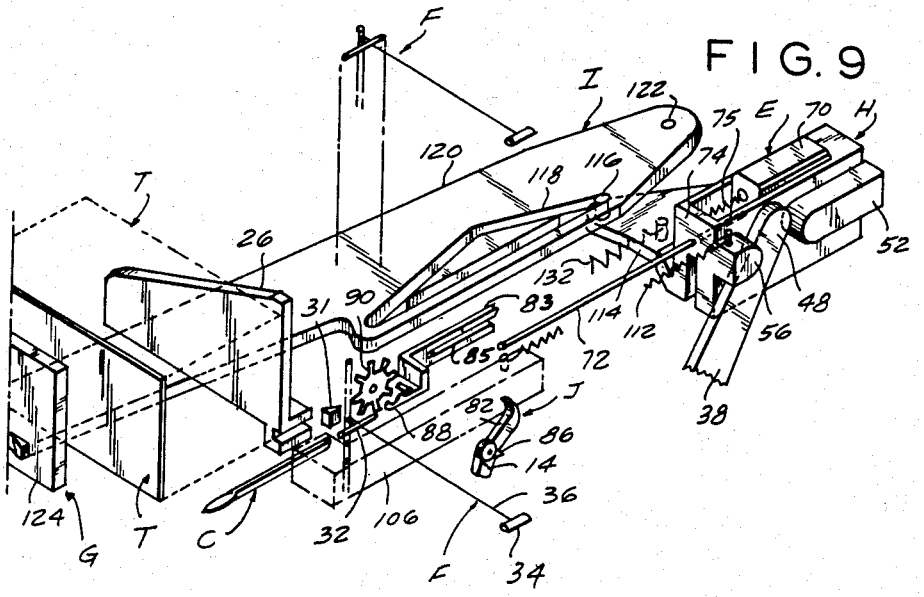
FIGS. 9–12 are schematic views of the tag dispensing and attaching apparatus of the present invention, showing various stages of the tagging sequence.

FIGS. 9–12 schematically illustrate the operation of the apparatus of the present invention. FIG. 9 shows all parts in their initial positions. After loading a clip of fasteners F into the apparatus and situating a stack of tags T between anvil 24 and pressure plate 26, the front end of the apparatus is held adjacent the article to be tagged. Trigger 12 is depressed. The depressing of trigger 12 causes lever 38 to move slide 52 forward.

Figure 10:
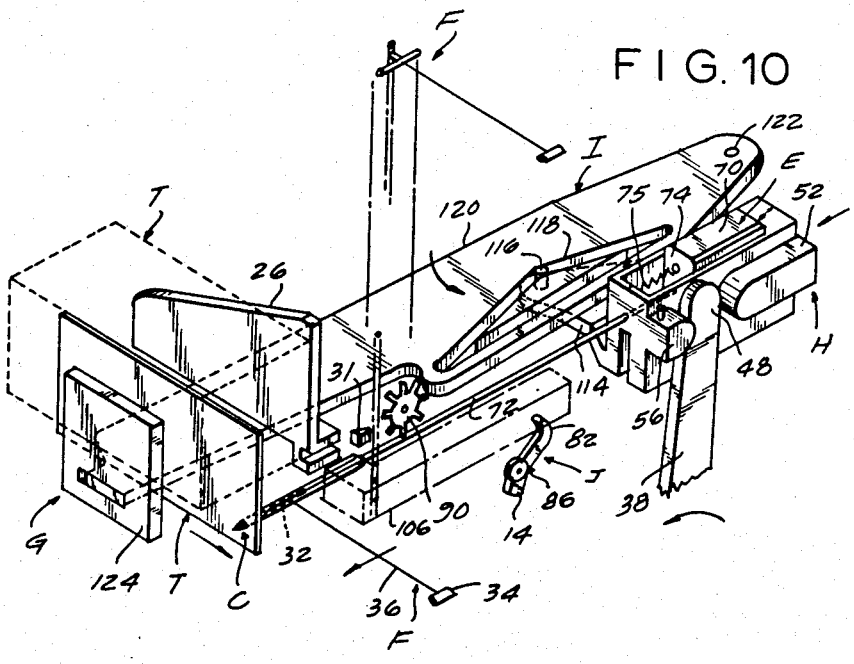

The forward movement of slide 52 causes several operations to occur. Slide 52 carries along with it slide 70 (spring-loaded against the rear of recess 66). Slide 70 has plunger 72 mounted to the front end thereof. The tip of plunger 72 will engage the T-bar end 32 of a fastener F aligned with needle C causing it to be severed from the clip and moved forward into the bore of needle C. The forward movement of slide 52 (through arm 114, pin 116, and track 118) will also cause lever 120 to move tag slide 124 from its original position, adjacent the stack, to a position proximate needle C, such that the first tag on the stack will be in alignment with needle C. This position is shown in FIG. 10.

Figure 11:
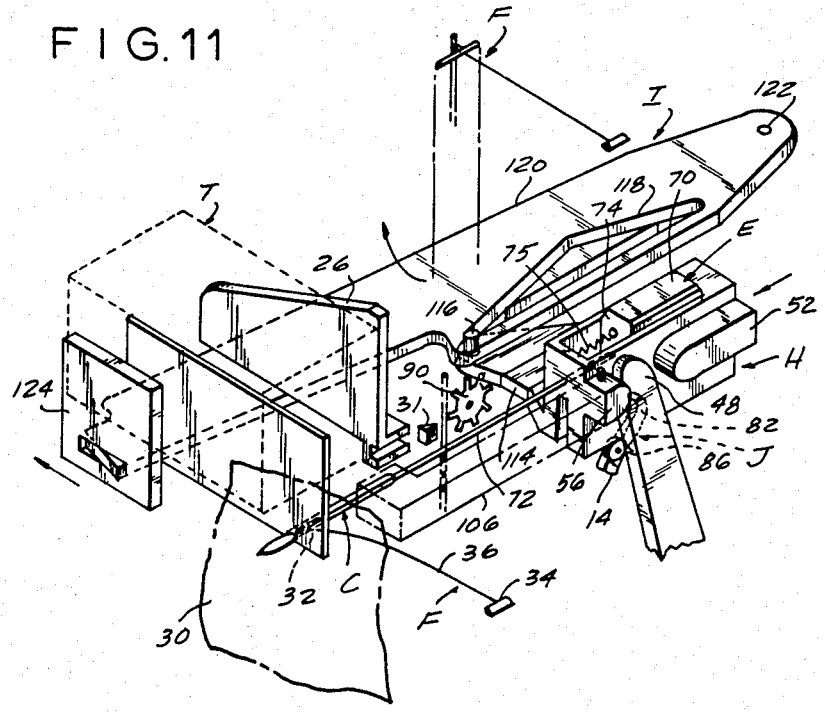
Figure 12:
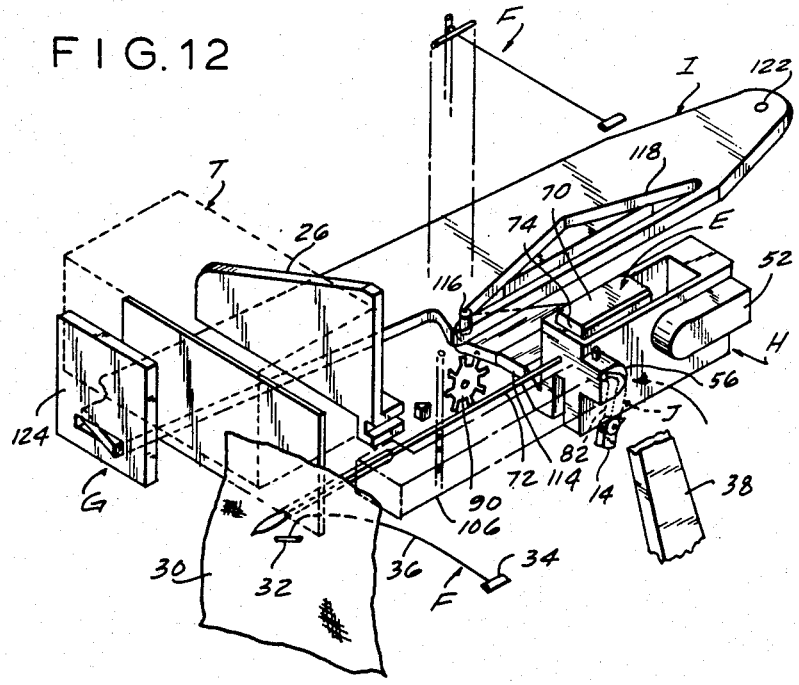

Further forward movement of slide 52 will first cause part 94, and thus needle C, to move forward, piercing the aligned tag and then cause lever 120 to move back towards its original position, causing slide 124 to return to a position in alignment with the tag stack. This is illustrated in FIG. 11.

At this point, the operator depresses trigger 14. This causes slide 70 to move forward relative to slide 52 (within recess 68) such that the T-bar end 32 of fastener F is moved through and pushed out of the end of needle C. At the same time, the depression of trigger 14 causes lobe 86 to engage finger 64 of the latch spring 62, and release the latch, permitting slide 52 to move back toward its rearward position due to the urging of torsion spring 42. As slide 52 returns to its rearward position, pin 116 rides along track section 118*a* without causing movement of tag slide 124. However, slide 52 causes part 94 and, thus, needle C to retract to its original position, through the action of spring 112, which interconnects slide 52 with section 106 of part 94. In addition, as slide 52 retracts, feed wheel 90 is advanced by the action of pawl 88 such that the T-bar end 32 of the next fastener F is automatically aligned with the needle bore. Upon completion of the rearward movement of slide 52, the apparatus again appears as illustrated in FIG. 9. The apparatus and article 30 can then be moved apart such that the tag, now loosely retained behind anvil 24, can be easily removed from the apparatus. The apparatus is now ready for the next tagging operation.

It will now be appreciated that the present invention relates to a tag dispensing and attaching apparatus which facilitates the tagging operation without fatiguing the operator. This is accomplished by automatically feeding a tag into alignment with an advancing needle, by depressing a first trigger. A second trigger is then depressed to dispense the fastener through the tag and the article to be tagged. Thus, the apparatus is operated entirely by the squeezing of triggers, the pressures of which can be regulated such that operator fatigue is greatly reduced.

Fatigue is further reduced because the apparatus is light in weight, easily manipulatable, and can be operated by a single hand of the operator. It is mechanically simple, operates reliably, and constructed relatively of inexpensive parts which cooperate together for a long, useful life with a minimum of maintenance.

The apparatus is designed to utilize conventional plastic fasteners which are inexpensive and widely available from a number of different companies. The apparatus is designed for use with tags of a variety of different dimensions and can operate satisfactorily with large number of tags without jamming.

It should also be appreciated that although the apparatus of the present invention is primarily designed for hand-held use and has thus been described for this mode of operation, the apparatus could easily be adapted for use for powered operations. In such operations, external means such as pneumatic cylinders, solenoids, or the like, could be utilized to depress trigger 14 on command and automatically cycle to depress trigger 12 a specified time after the depression of trigger 14. This would virtually completely automate the tagging operation.

While only a single preferred embodiment of the present invention has been disclosed herein for purposes of of illustration, it is obvious that many variations and modifications could be made thereto. It is intended to cover all of these variations and modifications which fall within the scope of the present invention, as defined by the following claims:

I claim:

1. Tag attaching apparatus, comprising: a housing including a manually engageable handle and means for mounting a stack of tags, actuating means disposed at the handle and mounted on the housing for movement relative to the housing, a hollow needle through which a fastener is dispensed, means for mounting the needle to the housing for movement between an original position and an extended position, means for moving a fastener through said needle including means for moving the needle mounting means from the original position to the extended position in response to actuation of the actuating means, means for causing said fastener moving means to move the fastener through the needle in response to further actuation of the actuating means, wherein the means for moving a fastener through the needle includes a plunger movable between retracted and extended positions, means for feeding a fastener to the needle, and means for preventing operation of the fastener feeding means until the plunger has substantially completely returned to its retracted position.

2. Tag attaching apparatus as defined in claim 1, wherein the preventing means includes a latch.

3. Tag attaching apparatus comprising a housing including a manually engageable handle and means for mounting a stack of tags, tag dispensing means and means for mounting a fastener to a tag, said tag dispensing means comprising actuating means disposed at the handle and means for operably connecting said actuating means and said tag dispensing means, said fastener mounting means including a needle, said tag dispensing means being responsive to actuation of said actuating means to move a fastener through the needle, said connecting means being effective, in response to the actuation of said actuating means, to cause said tag dispensing means to move a tag into alignment with said fastener mounting means, said tag dispensing means comprising a slide and a lever to which said slide is connected, said lever being movable between a first position, wherein said slide engages a tag and a second position, wherein said engaged tag is aligned with said fastener mounting means, said lever comprising a cam track and connecting means comprising a pin adapted to move within said track.

4. The apparatus of claim 3, wherein said cam track comprises a continuous path between first and second points, said path comprising a first section extending in a substantially straight line between said points and a second section extending between said points and comprising first and second parts, said first and second parts intersecting at an angle.

5. The apparatus of claim 3, wherein said angle is less than 180°.

6. A hand-held tag attacher for attaching tags to merchandise using fasteners, each fastener having a bar section and a button section joined by a filament section, the attacher being solely manually powered and comprising: an attacher body having a hopper adapted to receive a stack of tags and a manually engageable handle, a needle mounted to the body and having an elongate needle bore and an elongate side opening communicating with the needle bore, means for feeding an endmost tag from the hopper to an attaching position in alignment with the needle, means for advancing one bar section of a fastener at a time into alignment with the needle bore, a push rod engageable with a bar section of a fastener for driving the bar section through the needle bore while its filament section extends through the side opening, means for moving the bar section advancing means, the push rod and the tag feeding means through a cycle, wherein the moving means includes a slide movably mounted on the body, manually operable actuating means disposed at the handle, means for coupling the actuating means to the slide to effect reciprocating movement of the slide upon actuation and release of the actuating means, means for coupling the slide to the push rod, means responsive to the movement of the slide for operating the bar section advancing means, means for coupling the slide to the tag feeding means, and wherein the actuating means includes a first manually operable actuator for moving the push rod to a position in which the bar section of a fastener is moved to a position within the needle bore and a second manually operable actuator for moving the push rod from its position in the needle bore to a position out of the needle bore.

7. A hand-held tag attacher as defined in claim 6, wherein the means for coupling the slide to the tag feeding means includes a lever driven by the slide.

8. A hand-held tag attacher as defined in claim 6, wherein the means for coupling the slide to the tag feeding means includes a cam driven by the slide and a cam follower driven by the cam and coupled to the tag feeding means.

9. A hand-held tag attacher as defined in claim 8, wherein the follower includes a lever.

10. A hand-held tag attacher as defined in claim 6, wherein the means for coupling the slide to the tag feeding means includes a cam coupled to the slide and a lever moved by the cam, and wherein the tag feeding means includes a pin engageable with an endmost tag in the stack.

11. A hand-held tag attacher for attaching tags to merchandise using fasteners, each fastener having a bar section and a button section joined by a filament section, the attacher being solely manually powered and comprising: an attacher body having a hopper adapted to receive a stack of tags and having a manually engageable handle, a needle mounted to the body and having an elongate needle bore and an elongate side opening communicating with the needle bore, means for advancing one bar section at a time into alignment with the needle bore, a push rod engageable with a bar section of a fastener for driving the bar section through the needle bore while its filament section extends through the side opening, a tag feeder engageable with an endmost tag in the hopper for feeding the endmost tag from its position in the stack along a path to an attaching position in alignment with the needle, means for moving the bar section advancing means, the push rod and the tag feeder through a cycle, wherein the moving means includes manually operable actuating means disposed at the handle, means responsive to actuation of the actuating means for moving the bar section axially partly through the needle bore, and means responsive to the further actuation of the actuating means for moving the bar section the remainder of the way out of the needle bore, wherein the moving means further includes a cam and a lever driven by the cam, wherein the tag feeder includes a slide, a pin mounted for reciprocating movement on the slide, and means for coupling the lever to the slide.

12. A hand-held tag attacher for attaching tags to merchandise using fasteners, each fastener having a bar section and a button section joined by a filament section, the attacher being solely manually powered and comprising: an attacher body having a hopper adapted to receive a stack of tags and having a manually engageable handle, a needle mounted to the body and having an elongate needle bore and an elongate side opening communicating with the needle bore, means for advancing one bar section at a time into alignment with the needle bore, a push rod engageable with a bar section of a fastener for driving the bar section through the needle bore while its filament section extends through the side opening, a tag feeder engageable with an endmost tag in the hopper for feeding the endmost tag from its position in the stack along a path to an attaching position in alignment with the needle, means for moving the bar section advancing means, the push rod and the tag feeder through a cycle, wherein the moving means includes manually operable actuating means disposed at the handle, wherein the moving means further includes a first slide, a second slide mounted for relative movement on the first slide, the push rod being connected to the second slide, wherein the push rod is movable between retracted and extended positions through an intervening partially extended position, wherein the first slide moves the second slide to move the push rod to its partially extended position in which the bar section is in the needle bore in response to movement of the actuator from its initial position to its actuated position, and manually operable means for moving the push rod from its partially extended position to its extended position.

13. A hand-held tag attacher as defined in claim 12, wherein the actuator comprises a first lever and the manually operable means comprises a second lever.

14. A hand-held tag attacher as defined in claim 12, wherein the attacher includes a cam operable by the first slide for moving the tag feeder.

15. A hand-held tag attacher as defined in claim 12, wherein the attacher includes a cam connected to the slide, and a follower movable in response to movement of the cam for moving the tag feeder.

16. A hand-held tag attacher for attaching tags to merchandise using fasteners, each fastener having a bar section and a button section joined by a filament section, the attacher being solely manually powered and comprising: an attacher body having a hopper adapted to receive a stack of tags and a manually engageable handle, a needle mounted to the body and having an elongate needle bore and an elongate side opening communicating with the needle bore, manually operable actuating means disposed at the handle and being operable by the operator's fingers while the handle is held in the hand, a tag feeder engageable with an endmost tag in the stack and movable between a retracted position and an advanced position in which a tag has been moved to an attaching position, means responsive to movement of the actuating means for moving the tag feeder from the retracted position to the advanced position and for moving the tag feeder from the advanced position to the retracted position, means responsive to movement of the actuating means for advancing one bar section of a fastener at a time into alignment with the needle bore, a push rod responsive to movement of the actuating means and engageable with a bar section of a fastener for driving the bar section through the needle bore while its filament section extends through the side opening, wherein the actuating means includes means for moving the push rod to push the bar section partly through the needle bore and means responsive to further actuation of the actuating means when the needle has pierced the tag and the merchandise for moving the push rod to push the bar section the remainder of the way out of the needle bore.

* * * * *